US011691088B1

(12) United States Patent
Gu

(10) Patent No.: US 11,691,088 B1
(45) Date of Patent: Jul. 4, 2023

(54) INFLATABLE DOLL

(71) Applicant: COMIN INTERNATIONAL INC, City of Industry, CA (US)

(72) Inventor: Yumin Gu, City of Industry, CA (US)

(73) Assignee: COMIN INTERNATIONAL INC, City of Industry, CA (US)

( * ) Notice: Subject to any disclaimer, the term of this patent is extended or adjusted under 35 U.S.C. 154(b) by 0 days.

(21) Appl. No.: 17/828,061

(22) Filed: May 31, 2022

(51) Int. Cl.
*A63H 3/06* (2006.01)
*A63H 3/36* (2006.01)
*A63H 3/28* (2006.01)

(52) U.S. Cl.
CPC ..... *A63H 3/06* (2013.01); *A63H 3/28* (2013.01); *A63H 3/36* (2013.01)

(58) Field of Classification Search
CPC ... A63H 3/06; A63H 3/28; A63H 3/36; A63H 2027/1033; A63H 2027/1058; A63H 2027/1075; A63H 27/10
USPC ..... 446/220, 223, 226
See application file for complete search history.

(56) References Cited

U.S. PATENT DOCUMENTS 5,380,234 A * 1/1995 Ledford ..... A63H 3/06 446/362
6,186,857 B1 * 2/2001 Gazit ..... G09F 15/0025 40/406
6,447,361 B1 * 9/2002 Akiyama ..... A63H 3/06 137/625.21
6,786,793 B1 * 9/2004 Wang ..... A63H 27/10 446/176
7,197,841 B2 * 4/2007 Hsu ..... G09F 15/0025 40/212
7,216,446 B2 * 5/2007 Machala ..... G09F 19/08 446/221
7,322,137 B2 * 1/2008 Machala ..... G09F 19/08 40/410
8,800,186 B2 * 8/2014 Zhang ..... G09F 19/02 40/610
8,851,955 B2 * 10/2014 Zhang ..... A63H 3/06 446/268
10,227,972 B2 * 3/2019 Shao ..... F04B 49/02
10,830,229 B1 * 11/2020 Lurker ..... F04B 35/04
2006/0111012 A1 * 5/2006 Machala ..... G09F 19/08 446/226
2007/0022642 A1 * 2/2007 Hsu ..... G09F 15/0025 446/226
2008/0233831 A1 * 9/2008 Hsu ..... F04D 29/4246 446/221

(Continued)

*Primary Examiner* — Joseph B Baldori

(57) ABSTRACT

Provided is an inflatable doll, including a body, at least one airbag and an air blower assembly. The body includes a primary portion having a first air inlet, and a secondary portion. Each airbag defines a second air inlet, the airbag is connected with the primary portion and/or the secondary portion. The air blower assembly includes a first air blower adjacent to the first air inlet, and at least one second air blower at least partially received in the second air inlet. The first air blower is configured to inflate the primary portion, the secondary portion and the airbag. The at least one second air blower is configured to deflate the primary portion and/or the secondary portion. The second air blower is intermittently actuated, so that the primary portion and/or the secondary portion is intermittently inflated or deflated, for bringing the primary portion and/or the secondary portion to move.

12 Claims, 6 Drawing Sheets

(56) References Cited

U.S. PATENT DOCUMENTS

| | | | | |
|---|---|---|---|---|
| 2009/0286449 | A1* | 11/2009 | Tsai | A63H 3/06 446/224 |
| 2014/0148079 | A1* | 5/2014 | Zhang | A63H 13/02 446/226 |
| 2017/0056779 | A1* | 3/2017 | Zhang | F16K 11/0525 |

* cited by examiner

INFLATABLE DOLL

FIELD OF THE DISCLOSURE

The present disclosure relates to the field of dolls, and in particular to an inflatable doll.

BACKGROUND OF THE DISCLOSURE

At present, all kinds of conventional inflatable dolls are displayed in or in front of supermarkets or amusement parks to attract customers or visitors and create a friendly atmosphere. A conventional inflatable decoration has a body made of fabric material and a barrel which has a base formed on a lower end of the barrel. The body is mounted on the barrel so that the body is suspended above the ground. An air inlet is defined in the base and in communication with the interior of the body and an inflator is mounted on the base. A vent hole is defined in the inflator and corresponds to the air inlet so that air can be blown into the body when the inflator is operating. Hence, the body erects to attract the customers.

However, the conventional inflatable doll lacks dynamic movement and so soon becomes unattractive to passersby. Therefore, the present disclosure provides an inflatable doll to mitigate or obviate the aforementioned problems.

SUMMARY OF THE DISCLOSURE

In view of the foregoing disadvantage inherent in the existing art, the general purpose of the present disclosure is to provide an inflatable doll, to include all advantages of the existing art, and to overcome the drawback inherent in the existing art.

An object of the present disclosure is to provide an inflatable doll. The inflatable doll includes a body, at least one airbag and an air blower assembly received in the body. The body includes a primary portion having a first air inlet, and a secondary portion connected and communicated with the primary portion. Each airbag defines a second air inlet, the at least one airbag is connected with the primary portion and/or the secondary portion. The air blower assembly includes a first air blower received in the primary portion and adjacent to the first air inlet, and at least one second air blower at least partially received in the second air inlet. The first air blower is configured to introduce air into the primary portion and the secondary portion, to inflate the primary portion, the secondary portion, and the at least one airbag. The at least one second air blower is configured to direct air out of the at least one airbag, to deflate the primary portion and/or the secondary portion. the at least one second air blower is intermittently actuated, so that the primary portion and/or the secondary portion is intermittently inflated or deflated, for bringing the primary portion and/or the secondary portion to move.

In at least one embodiment, the at least one airbag includes at least one first airbag having a substantially triangular prism shape, the at least one first airbag is received in the primary portion and/or the at least one secondary portion, and connected with the primary portion and/or the at least one secondary portion.

In at least one embodiment, the first airbag includes a bottom surface, and two opposite triangular surfaces connected with two sides of the bottom surface respectively, a bottom angle formed by the bottom surface and one of the two opposite triangular surfaces 222 is 30~60°.

In at least one embodiment, the at least one airbag includes a plurality of first airbags received in the primary portion or the at least one secondary portion, and connected with the primary portion or the at least one secondary portion.

In at least one embodiment, the at least one airbag includes a plurality of first airbags, the first airbags are respectively received in the primary portion and the at least one secondary portion, and connected with the primary portion and the at least one secondary portion.

In at least one embodiment, the at least one airbag includes at least one second airbag having a substantially hexahedral shape, the at least one second airbag is received in the primary portion and/or the at least one secondary portion, and connected with the primary portion and/or the at least one secondary portion.

In at least one embodiment, the at least one second airbag includes a plurality of second airbags received in the primary portion or the at least one secondary portion, and connected with the primary portion or the at least one secondary portion.

In at least one embodiment, the at least one second airbag includes a plurality of second airbags respectively received in the primary portion and the at least one secondary portion, and connected with the primary portion and the at least one secondary portion.

In at least one embodiment, the at least one airbag includes at least one third airbag connected with the primary portion and/or the at least one secondary portion, the at least one third airbag includes a substantially irregular hexahedral shape having at least one arc side surface.

In at least one embodiment, the at least one third airbag includes a plurality of third airbag received in the primary portion or the at least one secondary portion, and connected with the primary portion or the at least one secondary portion.

In at least one embodiment, the at least one third airbag includes a plurality of third airbag respectively received in the primary portion and the at least one secondary portion, and connected with the primary portion and the at least one secondary portion.

In at least one embodiment, the primary portion further defines at least one air outlet. The inflatable doll further includes at least one sealing plug, configured to open or airtightly seal the air outlet.

In at least one embodiment, the inflatable doll further includes a power plug arranged on the primary portion, and a controller received in the primary portion, the power plug and the controller are both electrically connected with the air blower assembly.

In at least one embodiment, the inflatable doll further includes a speaker received in the primary portion or the secondary portion, the speaker is electrically connected with the controller.

In at least one embodiment, the inflatable doll further includes at least one lamp, received in the primary portion or the secondary portion, the at least one lamp is electrically connected with the controller.

In at least one embodiment, the inflatable doll further includes: a microphone, electrically connected with the controller and configured to collect a voice and transmit a voice signal to the controller; a first speech recognizing server, electrically connected with the controller and configured to recognize the voice signal and transmit a recognition result to the controller; a chip, electrically connected with the controller and pre-storing vocabularies, the chip is configured to output a feedback to the controller according to the vocabularies; and a second speech recognizing server, electrically connected with the controller and configured to transmit the feedback to the speaker, after the controller receiving the recognition result, the controller is configured to communicate with a user and send an instruction to the air blower assembly, the speaker, or the lamp, to control an operation of the air blower assembly, the speaker, or the lamp.

In at least one embodiment, the inflatable doll further includes a base, connected with the body and the first air blower, the base defines a third air inlet, communicated with the first air inlet, the first air blower is adjacent to the first air inlet and the third air inlet.

In at least one embodiment, the base further includes at least one foot arranged on a surface of the base opposite to the body.

In at least one embodiment, the inflatable doll further includes a supporting element arranged in the primary portion and connected with the first air blower.

In at least one embodiment, the supporting element defines a fourth air inlet communicated with the third air inlet and the first air inlet.

In the technical solution of the present disclosure, the first air blower is received in the primary portion and adjacent to the first air inlet, the first air blower may direct the external air into the primary portion through the first air inlet, to inflate the primary portion and the secondary portion. Simultaneously, the air in the primary portion and the secondary portion may flow into the at least one airbag through the second air inlet, to inflate the at least one airbag. The inflated airbag is connected with the primary portion and/or the secondary portion and hold the body in an upright state. The at least one second air blower is received in respective second air inlet, and the at least one second air blower is intermittently actuated and may intermittently lead out the air in the at least one airbag, the deflated airbag may bring the primary portion and/or the secondary portion to move downwards, or move towards right or left. After the second air blower stops working, the air in the primary portion and the secondary portion may flow into the at least one airbag to inflate the at least one airbag again, and the inflated airbag may bring the primary portion and/or the secondary portion to move upwards, or move back to the upright state. In this way, the primary portion and/or the secondary portion is intermittently inflated or deflated, for bringing the primary portion and/or the secondary portion to move. This cycle repeats, different portions of the body can move up and down, and/or move right and left, forming a set of dynamic movements to attract customers.

BRIEF DESCRIPTION OF THE DRAWINGS

The advantages and features of the present disclosure will become better understood with reference to the following detailed description taken in conjunction with the accompanying drawing, in which.

DETAILED DESCRIPTION OF THE DISCLOSURE

The exemplary embodiments described herein detail for illustrative purposes are subject to many variations in implementation. The present disclosure provides a valve core assembly. It should be emphasized, however, that the present disclosure is not limited only to what is disclosed and extends to cover various alternation to valve core assembly. It is understood that various omissions and substitutions of equivalents are contemplated as circumstances may suggest or render expedient, but these are intended to cover the application or implementation without departing from the spirit or scope of the present disclosure.

The terms "a" and "an" herein do not denote a limitation of quantity, but rather denote the presence of at least one of the referenced items.

The terms "having", "comprising", "including", and variations thereof signify the presence of a component.

Figure 1:
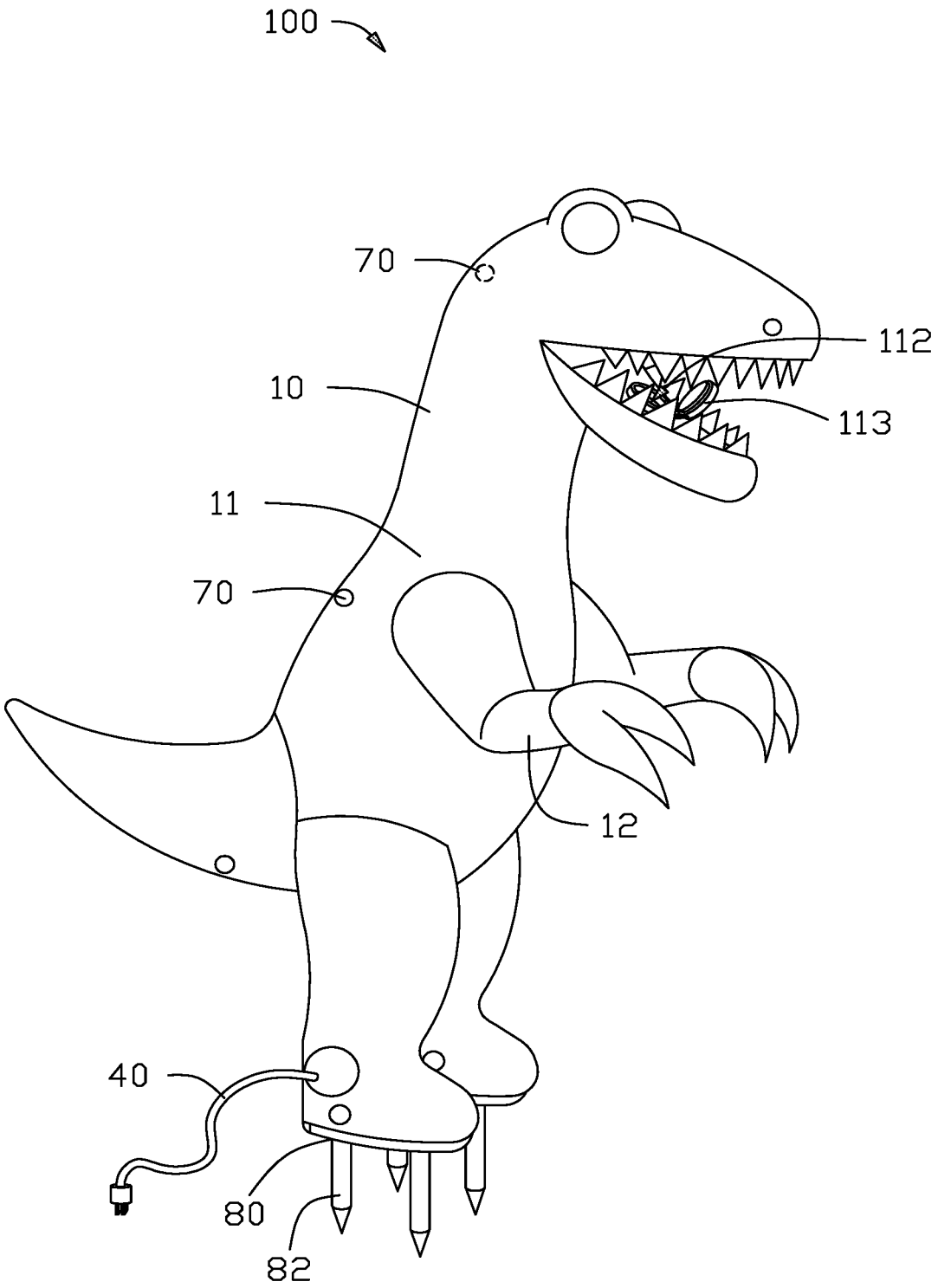
FIG. 1 is a structural schematic view of an inflatable doll according to an embodiment of the present disclosure.
Figure 2:
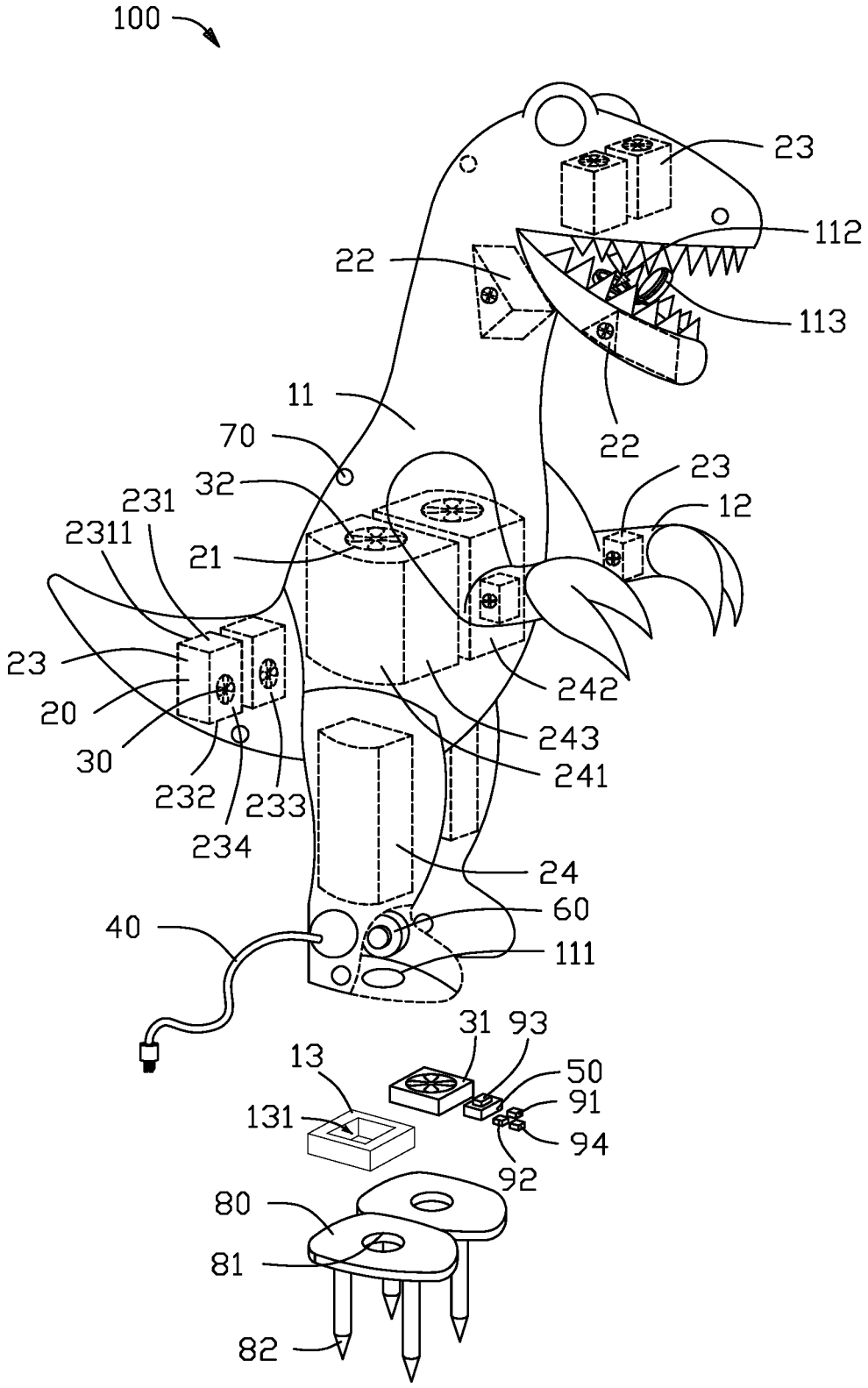
FIG. 2 is an exploded view of the inflatable doll in FIG. 1.

Referring to FIGS. 1 to 2, the present disclosure provides an inflatable doll 100 according to an embodiment.

The inflatable doll 100 includes a body 10, at least one airbag 20 and an air blower assembly 30 both received in the body 10. The body 10 includes a primary portion 11 having a first air inlet 111, and a secondary portion 12 connected and communicated with the primary portion 11. Each airbag 20 defines a second air inlet 21, the at least one airbag 20 is connected with the primary portion 11 and/or the secondary portion 12. The air blower assembly 30 includes a first air blower 31 received in the primary portion 11 and adjacent to the first air inlet 111, and at least one second air blower 32 at least partially received in the second air inlet 21. The first air blower 31 is configured to introduce air into the primary portion 11 and the secondary portion 12, to inflate the primary portion 11, the secondary portion 12, and the at least one airbag 20. The at least one second air blower 32 is configured to direct air out of the at least one airbag 20, to deflate the primary portion 11 and/or the secondary portion 12. The at least one second air blower 32 is intermittently actuated, so that the primary portion 11 and/or the secondary portion 12 is intermittently inflated or deflated, for bringing the primary portion 11 and/or the secondary portion 12 to move.

In at least one embodiment, the body 10 is made of fabric material which can be inflated to expand and erect to a prearranged configuration.

In the preferred embodiment, the inflatable doll 100 is like a dinosaur, the primary portion 11 is a dinosaur body including a belly, a neck and a leg, and the secondary portion 12 includes an arm, a jaw, and a tail.

In other embodiments, the inflatable doll 100 may be like a human, a car, a rabbit, and so on.

In at least one embodiment, an air inlet of the first air blower 31 is communicated with the first air inlet 111. So that, the external air may be blown into the body 10.

In at least one embodiment, the second air blower 32 is arranged in respective airbag 20 and faces towards the outside of respective airbag 20.

In at least one embodiment, an air outlet of the second air blower 32 faces towards an outside of the at least one airbag 20 through the second air inlet 21. So that, the air in the at least one airbag 20 may be directed into the primary portion 11 and the secondary portion 12.

In at least one embodiment, the at least one second air blower 32 is an intermittently actuated air blower.

In at least one embodiment, the first air blower 31 has a power of 5~300 W, and the second air blower 32 has a power of 5~100 W. The power of the second air blower may be set according to actual needs, so as to adjust the deflation rate of the at least one airbag 20, further to adjust a deformation rate of the primary portion 11 and/or the secondary portion 12.

In at least one embodiment, an air drafting capability of the second air blower 32 is lower in pressure than that of the first air blower 31. In at least one embodiment, the first air blower 31 has a power of 110~300 W, and the second air blower 32 has a power of 5~100 W.

In at least one embodiment, the primary portion 11 further defines at least one air outlet 112. The inflatable doll 100 further includes at least one sealing plug 113 configured to open or airtightly seal the air outlet 112.

In at least one embodiment, the secondary portion 12 includes at least one up and down moving part and at least one left and right moving part, the up and down moving part of the secondary portion 12 includes the neck, the arm, the leg, the jaw, and the tail, and the left and right moving part of the secondary portion 12 includes the neck, the arm, the leg, the belly, and the tail.

In at least one embodiment, the primary portion 11 includes at least one up and down moving part and at least one left and right moving part, the up and down moving part of the primary portion 11 includes the neck, the arm, the leg, the jaw, and the tail, and the left and right moving part of the primary portion 11 includes the neck, the arm, the leg, the belly, and the tail.

In the technical solution of the present disclosure, the first air blower 31 is received in the primary portion 11 and adjacent to the first air inlet 111, the first air blower 31 may direct the external air into the primary portion 11 through the first air inlet 111, to inflate the primary portion 11 and the secondary portion 12. Simultaneously, the air in the primary portion 11 and the secondary portion 12 may flow into the at least one airbag 20 through the second air inlet 21, to inflate the at least one airbag 20. The inflated airbag 20 is connected with the primary portion 11 and/or the secondary portion 12 and hold the body 10 in an upright state. The at least one second air blower 32 is received in respective second air inlet 21. The at least one second air blower 32 is intermittently actuated and may intermittently lead out the air in the at least one airbag 20, the deflated airbag 20 may bring the primary portion 11 and/or the secondary portion 12 to move downwards, or move towards right or left. After the second air blower 32 stops working, the air in the primary portion 11 and the secondary portion 12 may flow into the at least one airbag 20 to inflate the at least one airbag 20 again, and the inflated airbag 20 may bring the primary portion 11 and/or the secondary portion 12 to move upwards, or move back to the upright state. In this way, the primary portion 11 and/or the secondary portion 12 is intermittently inflated or deflated, for bringing the primary portion 11 and/or the secondary portion 12 to move. This cycle repeats, different portions of the body 10 can move up and down, and/or move right and left, forming a set of dynamic movements to attract customers.

Figure 3:
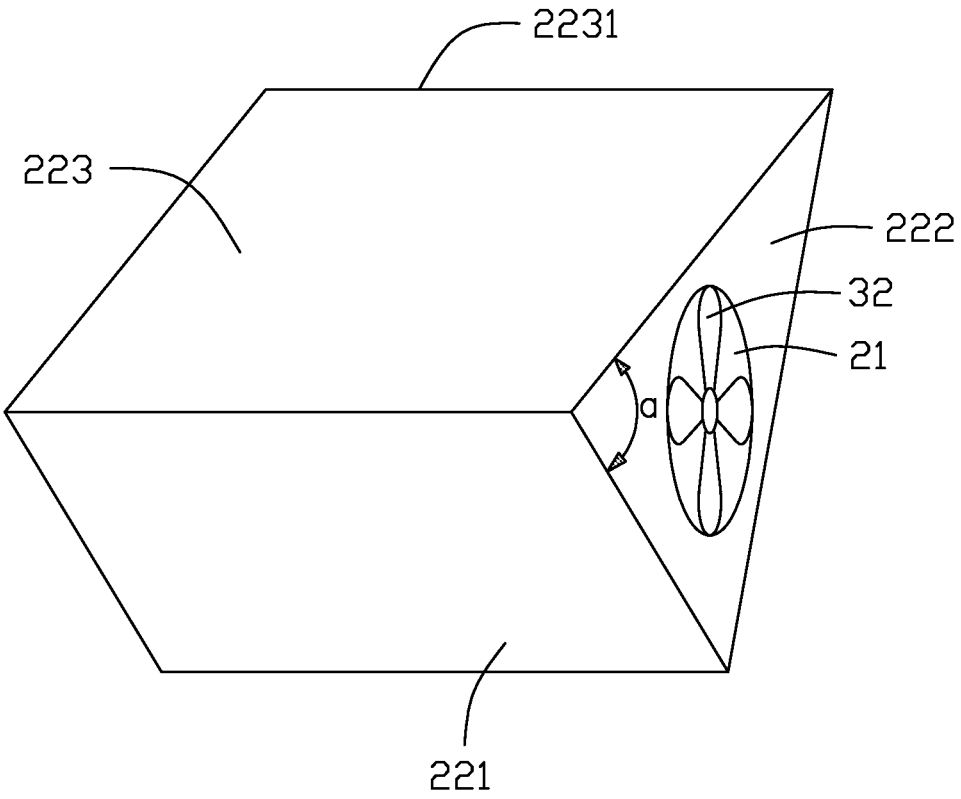
FIG. 3 is a structural schematic view of a first airbag of the inflatable doll in FIG. 2.

Referring to FIGS. 2 and 3, the at least one airbag 20 includes at least one first airbag 22 having a substantially triangular prism shape. The at least one first airbag 22 is received in the primary portion 11 and/or the at least one secondary portion 12, and connected with the primary portion 11 and/or the at least one secondary portion 12.

In at least one embodiment, a portion of the first airbag 22 is sewed with the primary portion 11 or the at least one secondary portion 12.

In at least one embodiment, a portion of the first airbag 22 is glued with the primary portion 11 or the at least one secondary portion 12.

In at least one embodiment, the first airbag 22 includes a bottom surface 221, two opposite triangular surfaces 222 connected with two sides of the bottom surface 221 respectively, and two parallelogram surfaces 223 connected with the bottom surface 221 and the triangular surfaces 222. A bottom angle $\alpha$ formed by the bottom surface 221 and one of the two opposite triangular surfaces 222 is 30~60°.

In at least one embodiment, at least one edge of the triangular prism is straight or curved.

In at least one embodiment, at least one edge of the bottom surface 221 is straight or curved.

In at least one embodiment, at least one edge of the triangular surface 222 is straight or curved.

In at least one embodiment, at least one edge of the parallelogram surface 223 is straight or curved.

In at least one embodiment, the connecting edge 2231 of the two parallelogram surfaces 223 is sewed or glued with the primary portion 11 or the at least one secondary portion 12.

In at least one embodiment, the bottom angle $\alpha$ is 30°, 40°, 50°, or 60°.

In at least one embodiment, the bottom angle $\alpha$ formed by the bottom surface 221 and each of the two opposite triangular surfaces 222 is 30~60°.

In at least one embodiment, the two parallelogram surfaces 223 are connected with each other, to form a connecting edge 2231, the connecting edge 2231 of the two parallelogram surfaces 223 is connected with the primary portion 11 or the at least one secondary portion 12, to support the primary portion 11 or the at least one secondary portion 12.

In at least one embodiment, an area of a cross section of the first airbag 22 is gradually decreased in a direction from the bottom surface 221 to the connecting edge 2231.

In at least one embodiment, the at least one airbag 20 includes a plurality of first airbags 22, the first airbags 22 are received in the primary portion 11 or the at least one secondary portion 12, and connected with the primary portion 11 or the at least one secondary portion 12.

In at least one embodiment, the at least one airbag 20 includes a plurality of first airbags 22, the first airbags 22 are respectively received in the primary portion 11 and the at least one secondary portion 12, and connected with the primary portion 11 and the at least one secondary portion 12.

In at least one embodiment, the first airbag 22 may be received in the up and down moving part of the primary portion 11 or the at least one secondary portion 12, and connected with the up and down moving part of the primary portion 11 or the at least one secondary portion 12, for bringing the up and down moving part of the primary portion 11 or the at least one secondary portion 12 to move up and down. In detail, the up and down moving part of the primary portion 11 or the at least one secondary portion 12 includes the neck, the jaw, the arm, the leg, and the tail.

In at least one embodiment, the first airbags 22 may be received in the up and down moving parts of the primary portion 11 or the at least one secondary portion 12, and connected with the up and down moving parts of the primary portion 11 or the at least one secondary portion 12. In detail, the up and down moving parts of the primary portion 11 or the at least one secondary portion 12 include at least two selected from the jaw, the neck, the arm, the leg, and the tail.

In at least one embodiment, the first airbag 22 may be deflated two to eight times per minute under an action of the second air blower 32.

In the technical solution of the present disclosure, the at least one first airbag 22 having a triangular prism shape is received in the primary portion 11 and/or the at least one secondary portion 12, and connected with the primary portion 11 and/or the at least one secondary portion 12. When the at least one first airbag 22 is filled with air, the inflated first airbag 22 can hold the primary portion 11 and/or the at least one secondary portion 12 in the upright state. When the second air blower 31 corresponding to the first airbag 22 works, the second air blower 31 leads out the air in the at least one first airbag 22, the at least one first airbag 22 brings the primary portion 11 and/or the at least one secondary portion 12 move downwards. When the second air blower 31 corresponding to the first airbag 22 stops working, the air in the body 10 flows into the at least one first airbag 22, the inflated first airbag 22 can hold the primary portion 11 and/or the at least one secondary portion 12 in the upright state again. This cycle repeats, the primary portion 11 and/or the at least one secondary portion 12 can move up and down. Further, the angle of the bottom angle is configured to limit a downward displacement of the at least one first airbag 22, and the second air blower 32 is configured to adjust the deflation rate of the at least one airbag 20, further to adjust the deformation rate of the primary portion 11 and/or the secondary portion 12.

Figure 4:
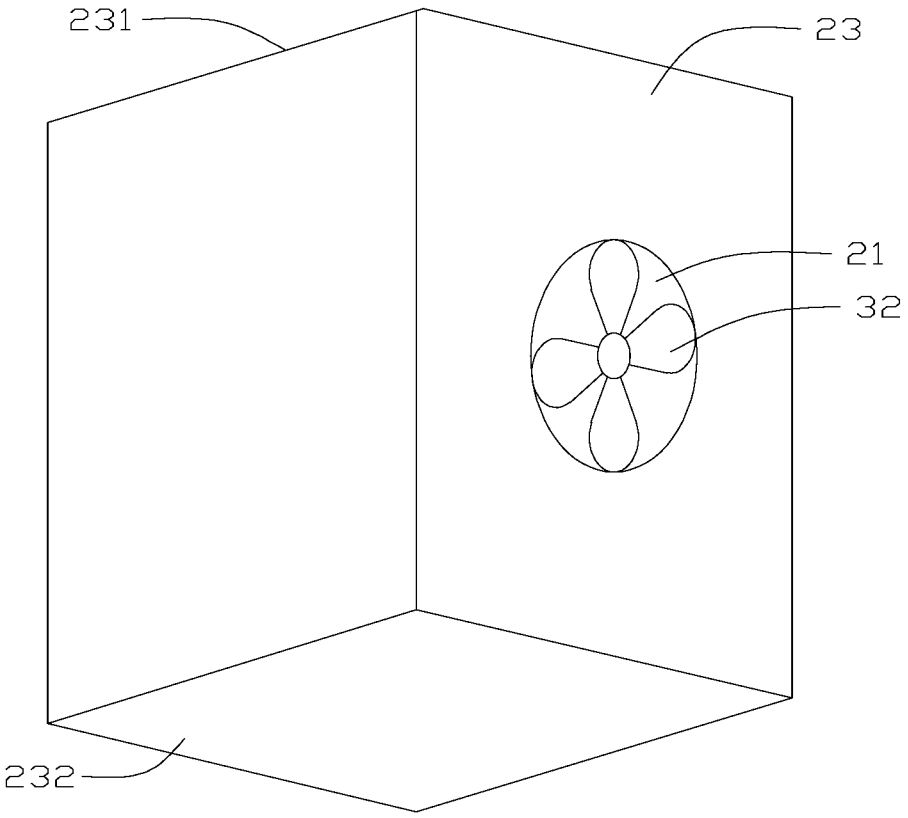
FIG. 4 is a structural schematic view of a second airbag of the inflatable doll in FIG. 2.

Referring to FIGS. 2 and 4, the at least one airbag 20 includes at least one second airbag 23 having a substantially hexahedral shape, the at least one second airbag 23 is received in the primary portion 11 and/or the at least one secondary portion 12 and connected with the primary portion 11 and/or the at least one secondary portion 12.

In at least one embodiment, a shape of the second airbag 23 is substantially a cube, a parallelepiped, or an irregular hexahedron.

In at least one embodiment, at least one edge of the hexahedron is straight or curved.

In at least one embodiment, a portion of the first airbag 22 is sewed with the primary portion 11 or the at least one secondary portion 12.

In at least one embodiment, a portion of the first airbag 22 is glued with the primary portion 11 or the at least one secondary portion 12.

In at least one embodiment, a top surface 231 of the hexahedral shaped second airbag 23 is connected with the primary portion 11 or the at least one secondary portion 12.

In at least one embodiment, the top surface 231 of the hexahedral shaped second airbag 23 is sewed or glued with the primary portion 11 or the at least one secondary portion 12.

In at least one embodiment, a bottom surface 232 of the hexahedral shaped second airbag 23 is connected with the primary portion 11 or the at least one secondary portion 12.

In at least one embodiment, the bottom surface 232 of the hexahedral shaped second airbag 23 is sewed or glued with the primary portion 11 or the at least one secondary portion 12.

In at least one embodiment, an edge 2311 of the top surface 231 of the hexahedral shaped second airbag 23 is sewed or glued with the primary portion 11 or the at least one secondary portion 12.

In at least one embodiment, the at least one second airbag 23 includes a plurality of second airbags 23, received in the primary portion 11 or the at least one secondary portion 12 and connected with the primary portion 11 or the at least one secondary portion 12.

In at least one embodiment, the at least one second airbag 23 includes a plurality of second airbags 23, respectively received in the primary portion 11 and the at least one secondary portion 12 and connected with the primary portion 11 and the at least one secondary portion 12.

In at least one embodiment, the second airbag 23 may be received in the up and down moving part of the primary portion 11 or the at least one secondary portion 12, and connected with the up and down moving part of the primary portion 11 or the at least one secondary portion 12, for bringing the up and down moving part of the primary portion 11 or the at least one secondary portion 12 to move up and down. In detail, the up and down moving part of the primary portion 11 or the at least one secondary portion 12 includes the jaw, the neck, the arm, the leg, and the tail.

In at least one embodiment, the second airbags 23 may be received in the up and down moving parts of the primary portion 11 or the at least one secondary portion 12, and connected with the up and down moving parts of the primary portion 11 or the at least one secondary portion 12, for bringing the up and down moving parts of the primary portion 11 or the at least one secondary portion 12 to move up and down. In detail, the up and down moving parts of the primary portion 11 or the at least one secondary portion 12 include at least two selected from the jaw, the neck, the arm, the leg, and the tail.

In at least one embodiment, the second airbag 23 may be deflated two to eight times per minute under the action of the second air blower 32.

In the technical solution of the present disclosure, the at least one second airbag 23 having a substantially hexahedral shape is received in the primary portion 11 and/or the at least one secondary portion 12 and connected with the primary portion 11 and/or the at least one secondary portion 12. When the at least one second airbag 23 is filled with air, the inflated second airbag 23 can hold the primary portion 11 and/or the at least one secondary portion 12 in the upright state. When the second air blower 31 corresponding to the second airbag 23 works, the second air blower 31 leads out the air in the at least one second airbag 23, the at least one second airbag 23 brings the primary portion 11 and/or the at least one secondary portion 12 move downwards. When the second air blower 31 corresponding to the second airbag 23 stops working, the air in the body 10 flows into the at least one second airbag 23, the inflated second airbag 23 can hold the primary portion 11 and/or the at least one secondary portion 12 in the upright state again. This cycle repeats, the primary portion 11 and/or the at least one secondary portion 12 can move up and down.

At least two second airbags 23 may be received in the left and right moving part of the primary portion 11 or the at least one secondary portion 12, and connected with the left and right moving part of the primary portion 11 or the at least one secondary portion 12, for bringing the left and right moving part of the primary portion 11 or the at least one secondary portion 12 to move left and right. In detail, the left and right moving part of the primary portion 11 or the at least one secondary portion 12 includes the belly, the neck, the arm, the leg, and the tail.

In at least one embodiment, two second airbags 23 are received in the belly and connected with the belly. A right airbag 233 of the two second airbags 23 deflates and brings the belly to move towards right, then the air in the body 10 flows back into the right airbag 233 of the two second airbags 23 to hold the belly in the upright state. A left airbag 234 of the two second airbags 23 deflates and brings the belly to move towards left, then the air in the body 10 flows back into the left airbag 234 of the two second airbags 23 to hold the belly in the upright state. This cycle repeats, the belly may move right and left.

In at least one embodiment, the right airbag 233 of the two second airbags 23 may be contracted for ten to thirty seconds under the action of the second air blower 32, then the left airbag 234 of the two second airbags 23 may be contracted for ten to thirty seconds under the action of another second air blower 32. The two second air blowers 32 may be intermittently actuated. This cycle repeats, the belly may move right and left.

Figure 5:
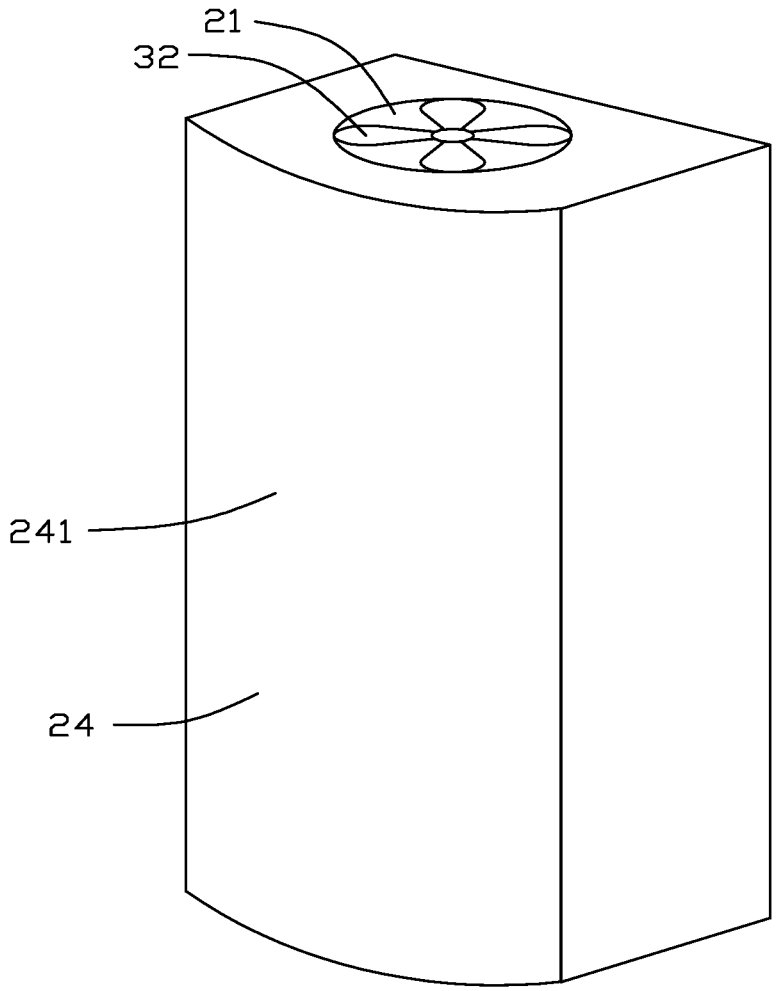
FIG. 5 is a structural schematic view of a third airbag of the inflatable doll in FIG. 2.

Referring to FIGS. 2 and 5, the at least one airbag 20 includes at least one third airbag 24 connected with the primary portion 11 and/or the at least one secondary portion 12, the at least one third airbag 24 includes a substantially irregular hexahedral shape having at least one arc side surface 242.

In at least one embodiment, at least one edge of the irregular hexahedron is straight or curved.

In at least one embodiment, the at least one third airbag 24 is sewed with the primary portion 11 or the at least one secondary portion 12.

In at least one embodiment, the at least one third airbag 24 is glued with the primary portion 11 or the at least one secondary portion 12.

In at least one embodiment, a side surface 241 of the third airbag 24 is connected with the primary portion 11 or the at least one secondary portion 12. The side surface 241 is matched in shape with an inner surface of the primary portion 11 or the at least one secondary portion 12.

In at least one embodiment, the side surface 241 of the third airbag 24 is sewed or glued with the primary portion 11 or the at least one secondary portion 12.

In at least one embodiment, the at least one third airbag 24 includes a plurality of third airbags 24, the third airbags 24 are received in the primary portion 11 or the at least one secondary portion 12, and connected with the primary portion 11 or the at least one secondary portion 12.

In at least one embodiment, the at least one third airbag 24 includes a plurality of third airbags 24, the third airbag 24 are respectively received in the primary portion 11 and the at least one secondary portion 12, and connected with the primary portion 11 and the at least one secondary portion 12.

In at least one embodiment, the third airbag 24 may be received in the up and down moving part of the primary portion 11 or the at least one secondary portion 12, and connected with the up and down moving part of the primary portion 11 or the at least one secondary portion 12, for bringing the up and down moving part of the primary portion 11 or the at least one secondary portion 12 to move up and down. The up and down moving part of the primary portion 11 or the at least one secondary portion 12 includes the jaw, the neck, the arm, the leg, and the tail.

In at least one embodiment, the third airbags 24 may be received in the up and down moving parts of the primary portion 11 or the at least one secondary portion 12, and connected with the up and down moving parts of the primary portion 11 or the at least one secondary portion 12, for bringing the up and down moving parts of the primary portion 11 or the at least one secondary portion 12 to move up and down. In detail, the up and down moving parts of the primary portion 11 or the at least one secondary portion 12 include at least two selected from the jaw, the neck, the arm, the leg, and the tail.

In at least one embodiment, the third airbag 24 may be deflated two to eight times per minute under the action of the second air blower 32.

In the technical solution of the present disclosure, the at least one third airbag 24 has a substantially irregular hexahedral shape, the irregular hexahedral shape has at least one arc side surface 242, the at least one third airbag 24 is received in the primary portion 11 and/or the at least one secondary portion 12 and connected with the primary portion 11 and/or the at least one secondary portion 12. When the at least one third airbag 24 is filled with air, the inflated third airbag 24 can hold the primary portion 11 and/or the at least one secondary portion 12 in the upright state. When the second air blower 31 corresponding to the third airbag 24 works, the second air blower 31 leads out the air in the at least one third airbag 24, the at least one third airbag 24 brings the primary portion 11 and/or the at least one secondary portion 12 move downwards. When the second air blower 31 corresponding to the third airbag 24 stops working, the air in the body 10 flows into the at least one third airbag 24, the inflated third airbag 24 can hold the primary portion 11 and/or the at least one secondary portion 12 in the upright state again. This cycle repeats, the primary portion 11 and/or the at least one secondary portion 12 can move up and down.

At least two third airbags 24 may be received in the left and right moving part of the primary portion 11 or the at least one secondary portion 12, the belly, the neck, the arm, the leg, or the tail, and connected with the left and right moving part of the primary portion 11 or the at least one secondary portion 12, for bringing the left and right moving part of the primary portion 11 or the at least one secondary portion 12 to move left and right. In detail, the left and right moving part of the primary portion 11 or the at least one secondary portion 12 includes the belly, the neck, the arm, the leg, and the tail.

In at least one embodiment, two third airbags 24 are received in the belly and connected with the belly. A right airbag 242 of the two third airbags 24 deflates and brings the belly to move towards right, then the air in the body 10 flows back into the right airbag 242 of the two third airbags 24 to hold the belly in the upright state. A left airbag 243 of the two third airbags 24 deflates and brings the belly to move towards left, then the air in the body 10 flows back into the left airbag 243 of the two third airbags 24 to hold the belly in the upright state. This cycle repeats, the belly may move right and left.

In at least one embodiment, the right airbag 242 of the two third airbags 24 may be contracted for ten to thirty minutes under the action of one second air blower 32, then the left airbag 243 of the two third airbags 24 may be contracted for ten to thirty minutes under the action of another second air blower 32. The two second air blowers 32 may be intermittently actuated. This cycle repeats, the belly may move right and left.

Figure 6:
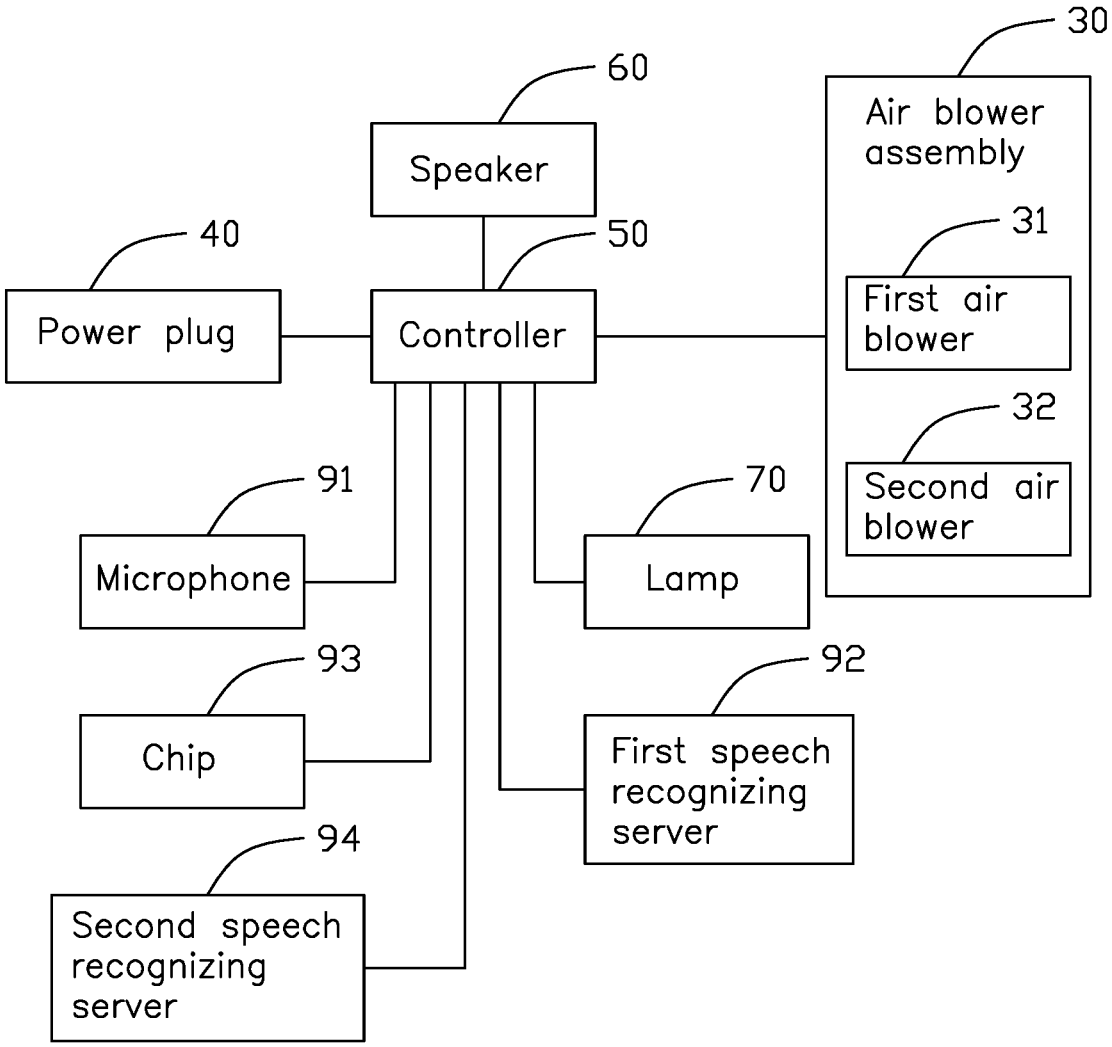
FIG. 6 is a structural block diagram of a controller, a power plug, a lamp, a speaker, and an air blower assembly of the inflatable doll in FIG. 1.

Referring to FIGS. 1, 2 and 6, the inflatable doll 100 further includes a power plug 40 arranged on the primary portion 11, and a controller 50 received in the primary portion 11, the power plug 40 and the controller 50 are both electrically connected with the air blower assembly 30.

In at least one embodiment, the controller 50 has an integrated circuit.

In at least one embodiment, the power plug 40 may be connected with an external power supply.

In the technical solution of the present disclosure, the power plug 40 and the controller 50 are both electrically connected with the air blower assembly 30, for controlling operations of the first air blower 31 and the second air blower 32.

The inflatable doll 100 further includes a speaker 60 received in the primary portion 11 or the secondary portion 12, the speaker 60 is electrically connected with the controller 50.

It should be understood that, the speaker 60 may play songs, stories, sounds of dinosaurs, etc.

It should be understood that, the controller 50 may adjust a deflation time and a deflation frequency of the at least one airbag 20, for bringing the body 10 to dance according to a rhythm of the music.

In the technical solution of the present disclosure, the speaker 60 is arranged in the primary portion 11 or the secondary portion 12, for attracting the customers.

The inflatable doll 100 further includes at least one lamp 70 received in the primary portion 11 or the secondary portion 12, or arranged on an outer surface of the primary portion 11 or the secondary portion 12, the at least one lamp 70 is electrically connected with the controller 50.

In at least one embodiment, the inflatable doll 100 further includes a plurality of lamps 70.

In at least one embodiment, the at least one lamp 70 may emit white light or color light.

In at least one embodiment, the lamp 70 may be a LED lamp.

In the technical solution of the present disclosure, at least one lamp 70 is arranged in the primary portion 11 or the secondary portion 12, for attracting the customers.

In the technical solution of the present disclosure, at least one lamp 70 is arranged on the outer surface of the primary portion 11 or the secondary portion 12, for attracting the customers.

The inflatable doll 100 further includes a microphone 91, a first speech recognizing server 92, a chip 93, and a second speech recognizing server 94 all received in the body 10. The microphone 91 is configured to collect a voice and transmit a voice signal to the controller 50. The first speech recognizing server 92 is electrically connected with the controller 50 and configured to recognize the voice signal and transmit a recognition result to the controller 50. The chip 93 is electrically connected with the controller and pre-storing vocabularies and configured to output a feedback to the controller 50 according to the vocabularies. The second speech recognizing server 94 transmits the feedback to the speaker 60, to communicate with user.

The controller 50 processes the voice signal and transmits the processed voice signal to the first speech recognizing server 92, the first speech recognizing server 92 recognizes the processed voice signal, and transmits the recognition result to the controller 50. The controller 50 sends the recognition result to the chip 93, then the chip 93 output the feedback to the controller 50 according to the vocabularies. The controller 50 sends the feedback to the second speech recognizing server 94, then the second speech recognizing server 94 transmits the feedback to the speaker 60, to communicate with user. In this way, the inflatable doll 100 may intelligently communicate with user.

In at least one embodiment, the chip 93 may be arranged on the controller 50.

In at least one embodiment, the controller 50 is configured to send an instruction to the air blower assembly 30, the speaker 60, or the lamp 70, to control an operation of the air blower assembly 30, the speaker 60, or the lamp 70.

In at least one embodiment, after the controller 50 receiving the voice signal, the controller 50 may send one instruction to the first air blower 31 to control the first air blower 31 to start working or stop working.

In at least one embodiment, after the controller 50 receiving the voice signal, the controller 50 may send one instruction to the second air blower 32 to control the second air blower 32 to start working or stop working. In detail, after the controller 50 receiving the voice signal, the controller 50 may send one instruction to the second air blower 32 to control the second air blower 32 to work intermittently.

In at least one embodiment, the inflatable doll 100 may change movements according to the rhythm of the music, and may move fast or slow according to the rhythm of music.

In at least one embodiment, after the controller 50 receiving the voice signal, the controller 50 may send one instruction to the speaker 60 to control the speaker 60 to play songs, stories, sounds of dinosaurs, etc.

In at least one embodiment, after the controller 50 receiving the voice signal, the controller 50 may send one instruction to the lamp 70 to control the lamp 70 to emit light.

The inflatable doll 100 further includes a base 80, connected with the body 10 and the first air blower 31. The base 80 defines a third air inlet 81 communicated with the first air inlet 111. The first air blower 31 is adjacent to the first air inlet 111 and the third air inlet 81.

In at least one embodiment, the base 80 is attached to a bottom end of the primary portion 11, so that the body 10 is suspended above the ground.

In at least one embodiment, the base 80 further includes at least one foot 82 arranged on a surface of the base 80 opposite to the body 10.

In at least one embodiment, the base 80 includes a plurality of feet 82 spaced apart from each other, the feet 82 are arranged on the surface of the base 80 opposite to the body 10.

The inflatable doll 100 further includes a supporting element 13 arranged in the primary portion 11, the supporting element 13 is connected with the first air blower 31.

In at least one embodiment, the supporting element 13 is arranged on the bottom end of the primary portion 11.

In at least one embodiment, the supporting element 13 is supported by the base 80.

In at least one embodiment, the supporting element 13 defines a fourth air inlet 131, the fourth air inlet 131 is communicated with the third air inlet 81 and the first air inlet 111.

In the technical solution of the present disclosure, the supporting element 13 is arranged in the bottom end of the primary portion 11, for stably supporting the first air blower 31.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, and to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the present disclosure.

What is claimed is:

1. An inflatable doll, comprising:

a body, comprising:

a primary portion, having a first air inlet; and a secondary portion, connected and communicated with the primary portion;

at least one flexible airbag, received in the primary portion or the secondary portion, the at least one flexible airbag defines a second air inlet, the at least one flexible airbag is connected with the primary portion or the secondary portion;

an air blower assembly, received in the body, the air blower assembly comprises:

a first air blower, received in the primary portion and adjacent to the first air inlet, the first air blower is configured to introduce air into the primary portion and the secondary portion, to inflate the primary portion, and the secondary portion; and at least one second air blower, at least partially received in the second air inlet, the at least one second air blower is configured to direct air out of the at least one flexible airbag, the at least one flexible airbag is deformed to move the primary portion or the secondary portion, the at least one second air blower is intermittently actuated, so that the at least one flexible airbag is intermittently inflated or deflated, for bringing the primary portion or the secondary portion to move, wherein the at least one flexible airbag comprises:

a plurality of first airbags, having a substantially triangular prism shape, the first airbags are received in the primary portion or the secondary portion and connected with the primary portion or the secondary portion; and a plurality of second airbags, having a substantially hexahedral shape, the second airbags are received in the primary portion or the secondary portion and connected with the primary portion or the secondary portion;

the inflatable doll further comprises:

a power plug, arranged on the primary portion;

a controller, received in the primary portion, the power plug and the controller are both electrically connected with the air blower assembly;

a speaker, received in the primary portion or the secondary portion, the speaker is electrically connected with the controller;

at least one lamp, received in the primary portion or the secondary portion, the at least one lamp is electrically connected with the controller;

a microphone, electrically connected with the controller and configured to collect a voice and transmit a voice signal to the controller;

a first speech recognizing server, electrically connected with the controller and configured to recognize the voice signal and transmit a recognition result to the controller;

a chip, electrically connected with the controller and pre-storing vocabularies, the chip is configured to output a feedback to the controller according to the vocabularies; and a second speech recognizing server, electrically connected with the controller and configured to transmit the feedback to the speaker, after the controller receiving the recognition result, the controller is configured to communicate with a user and send an instruction to the air blower assembly, the speaker, or the lamp, to control an operation of the air blower assembly.

2. The inflatable doll of claim 1, wherein the first airbag comprises:

a bottom surface; and a back surface, connected with the bottom surface, when the first airbag is inflated, an angle formed by the bottom surface and the back surface is 30~60°.

3. The inflatable doll of claim 1, wherein the first airbags are respectively received in the primary portion and the at least one secondary portion, and connected with the primary portion and the secondary portion.

4. The inflatable doll of claim 1, wherein the second airbags are respectively received in the primary portion and the secondary portion, and connected with the primary portion and the secondary portion.

5. The inflatable doll of claim 1, wherein the at least one flexible airbag comprises:

at least one third airbag, connected with the primary portion or the secondary portion, the at least one third airbag includes a substantially irregular hexahedral shape having at least one arc side surface.

6. The inflatable doll of claim 5, wherein the at least one third airbag comprises:

a plurality of third airbags, received in the primary portion or the secondary portion, and connected with the primary portion or the secondary portion.

7. The inflatable doll of claim 5, wherein the at least one third airbag comprises:

a plurality of third airbags, respectively received in the primary portion and the secondary portion, and connected with the primary portion and the secondary portion.

8. The inflatable doll of claim 1, wherein the primary portion further defines:

at least one air outlet;

the inflatable doll further comprises:

at least one sealing plug, configured to open or airtightly seal the air outlet.

9. The inflatable doll of claim 1, wherein further comprising:

a base, connected with the body and the first air blower, the base defines:

a third air inlet, communicated with the first air inlet, the first air blower is adjacent to the first air inlet and the third air inlet.

10. The inflatable doll of claim 9, wherein the base further comprises:

at least one foot, arranged on a surface of the base opposite to the body.

11. The inflatable doll of claim 9, wherein further comprising:

a supporting element, arranged in the primary portion and connected with the first air blower.

12. The inflatable doll of claim 11, wherein the supporting element defines:

a fourth air inlet, configured for communicating the first air inlet with the first air blower.

* * * * *